US007104808B2

(12) United States Patent
Korsunsky et al.

(10) Patent No.: US 7,104,808 B2
(45) Date of Patent: Sep. 12, 2006

(54) MATING EXTENDER FOR ELECTRICALLY CONNECTING WITH TWO ELECTRICAL CONNECTORS

(75) Inventors: Iosif R. Korsunsky, Harrisburg, PA (US); Joanne E. Shipe, Harrisburg, PA (US); Robert W. Brown, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/040,282

(22) Filed: Jan. 20, 2005

(65) Prior Publication Data

US 2006/0160380 A1 Jul. 20, 2006

(51) Int. Cl.
*H01R 12/00* (2006.01)

(52) U.S. Cl. ..... 439/76.1; 439/74; 439/608

(58) Field of Classification Search ..... 439/74, 439/76.1, 608, 76.4
See application file for complete search history.

(56) References Cited

U.S. PATENT DOCUMENTS 6,102,754 A 8/2000 Capper et al.
6,152,747 A 11/2000 McNamara
6,293,827 B1 9/2001 Stokoe
6,379,188 B1 4/2002 Cohen et al.
6,869,292 B1 * 3/2005 Johnescu et al. ..... 439/74
6,918,774 B1 * 7/2005 Wu ..... 439/65

* cited by examiner

*Primary Examiner*—Truc Nguyen
(74) *Attorney, Agent, or Firm*—Wei Te Chung

(57) ABSTRACT

A mating extender electrically engages with a pair of complementary connectors. The mating extender comprises an insulative housing having first and second mating sections, and a number of wafers parallelly assembled into the insulative housing. Each wafer comprises an insulative frame and a plurality of contacts each formed by a pair of electrically stacked semi-contacts. Each contact has an intermediate portion retained in the insulative frame, a pair of first contact tails and a pair of second contact tails at opposite ends of the intermediate portion and received in the first and the second mating sections of the insulative housing, respectively.

16 Claims, 13 Drawing Sheets

MATING EXTENDER FOR ELECTRICALLY CONNECTING WITH TWO ELECTRICAL CONNECTORS

BACKGROUND OF THE INVENTION

1. Field of the Invention

The present invention relates to a mating extender, and more particularly to a mating extender which is able to vary in height and is adapted for simultaneously and electrically connecting with a pair of headers respectively mounted on two printed circuit boards.

2. Description of Related Art

U.S. Pat. No. 6,152,747 discloses an electrical connector assembly comprising a plug and a receptacle. The plug and the receptacle both comprise a number of parallel modules. Each module comprises an insulative support, a plurality of signal contacts attached on one side of the support and a shielding plate attached on another side of the support. Each signal contact comprises a tail having a solder ball attached thereon. The shielding plate is formed with a plurality of end portions each having a solder ball attached thereon. The solder balls on the signal contacts and the shielding plate lie in a common plane. The plug is adapted for being surface mounted onto a first printed circuit board with the solder balls soldered onto corresponding pads on the first printed circuit board. The receptacle is adapted for being surface mounted onto a second printed circuit board positioned parallelly to the first printed circuit board with the solder balls soldered onto corresponding pads on the second printed circuit board.

In some applications, a large distance is required to be kept between the first and second printed circuit boards. Therefore, a high profile plug or receptacle is accordingly designed to satisfy this requirement. However, as the height of the plug or the receptacle increases, it becomes more difficult to surface solder the plug or the receptacle to the printed circuit boards.

Hence, a mating extender between the plug and the receptacle is desired to overcome the disadvantage of the prior art.

SUMMARY OF THE INVENTION

An object of the present invention is to provide a mating extender for simultaneously and electrically connecting with a pair of headers respectively mounted on two parallel printed circuit boards to match different distances between the printed circuit boards.

Another object of the present invention is to provide a mating extender comprising a plurality of contacts each having a redundant interface.

To achieve the above object, an mating extender electrically engages with a pair of complementary connectors. The mating extender comprises an insulative housing having first and second mating sections, and a number of wafers parallelly assembled into the insulative housing. Each wafer comprises an insulative frame and a plurality of contacts each formed by a pair of electrically stacked semi-contacts. Each contact has an intermediate portion retained in the insulative frame, a pair of first contact tails and a pair of second contact tails at opposite ends of the intermediate portion and received in the first and the second mating sections of the insulative housing, respectively.

Other objects, advantages and novel features of the invention will become more apparent from the following detailed description when taken in conjunction with the accompanying drawings.

DETAILED DESCRIPTION OF THE PREFERRED EMBODIMENT

Figure 4:
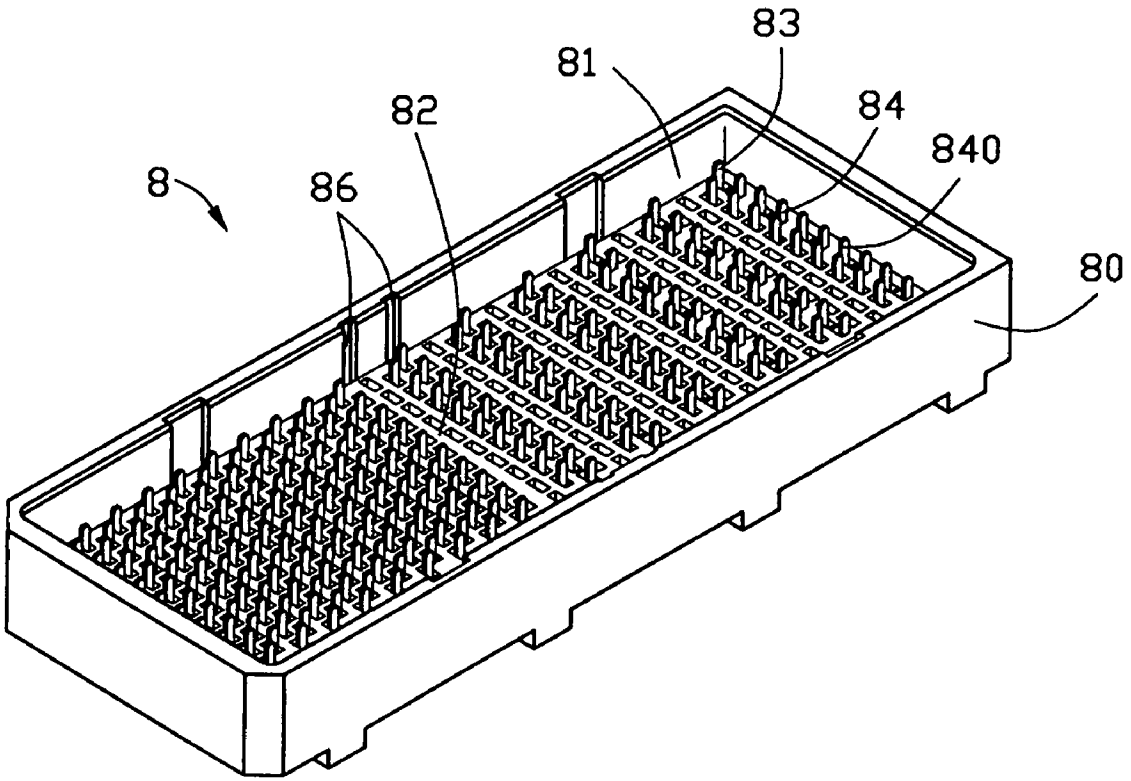
FIG. 4 is a perspective view of a header in accordance with the present invention.

Referring to FIGS. 1 and 8A–8C, a mating extender 1 in accordance with the present invention has a pair of opposite mating parts electrically and mechanically engaging with a pair of headers 8 (only one header shown in FIG. 4), respectively. One header 8 is generally adapted for being mounted onto a first Printed Circuit Board (PCB) (not shown) with a plurality of connector mounted thereon and another header 8 is adapted for mounting onto a second PCB (not shown) with a plurality of connector mounted thereon.

Figure 1:
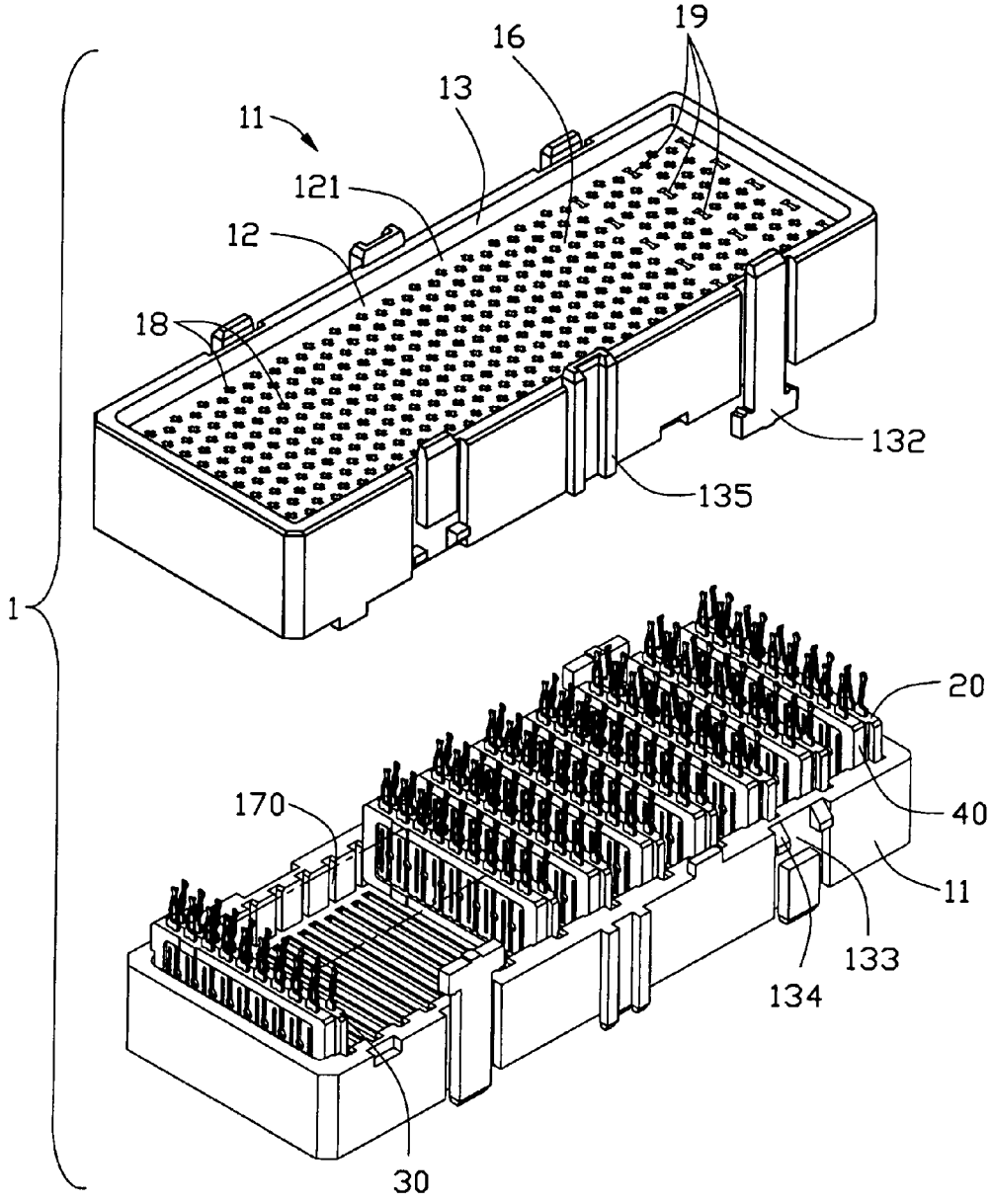
FIG. 1 is an exploded perspective view of a mating extender in accordance with the present invention.
Figure 2:
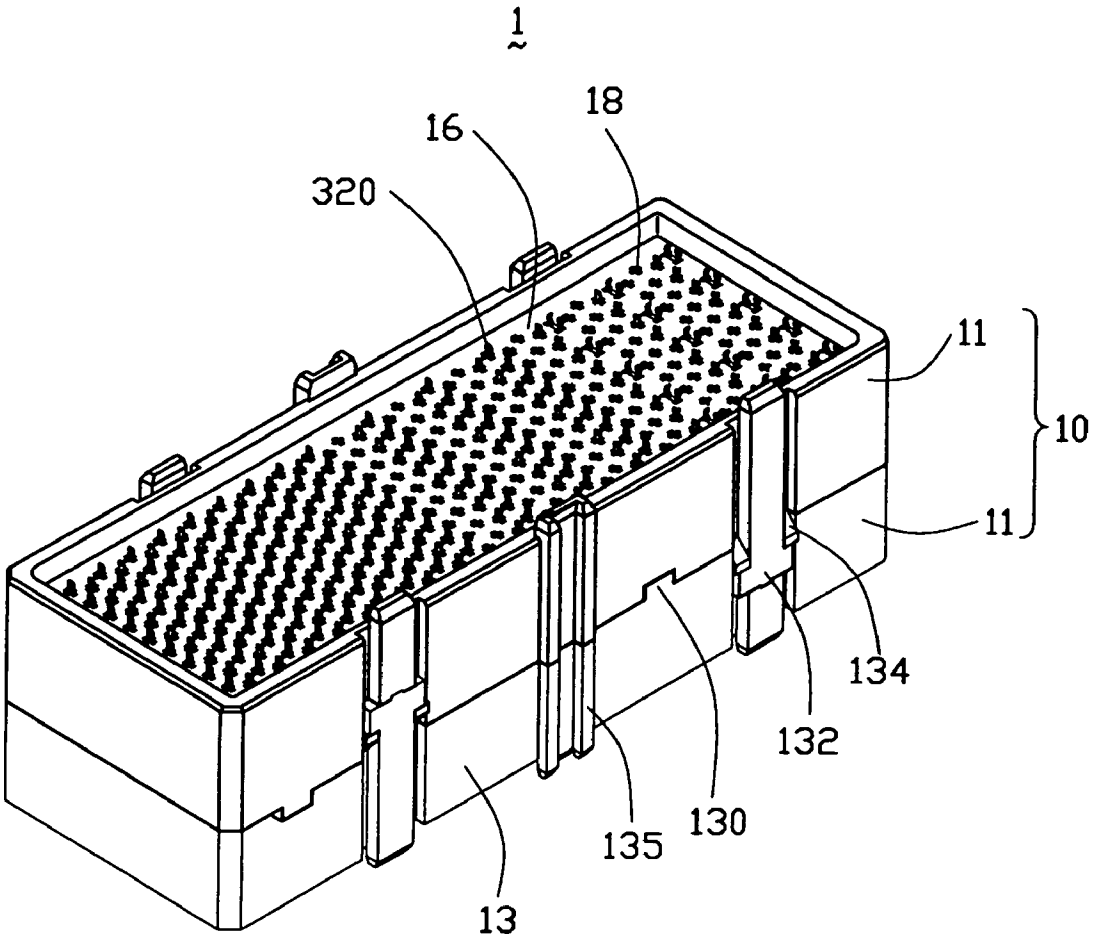
FIG. 2 is an assembled perspective view of the mating extender shown in FIG. 1.
Figure 3:
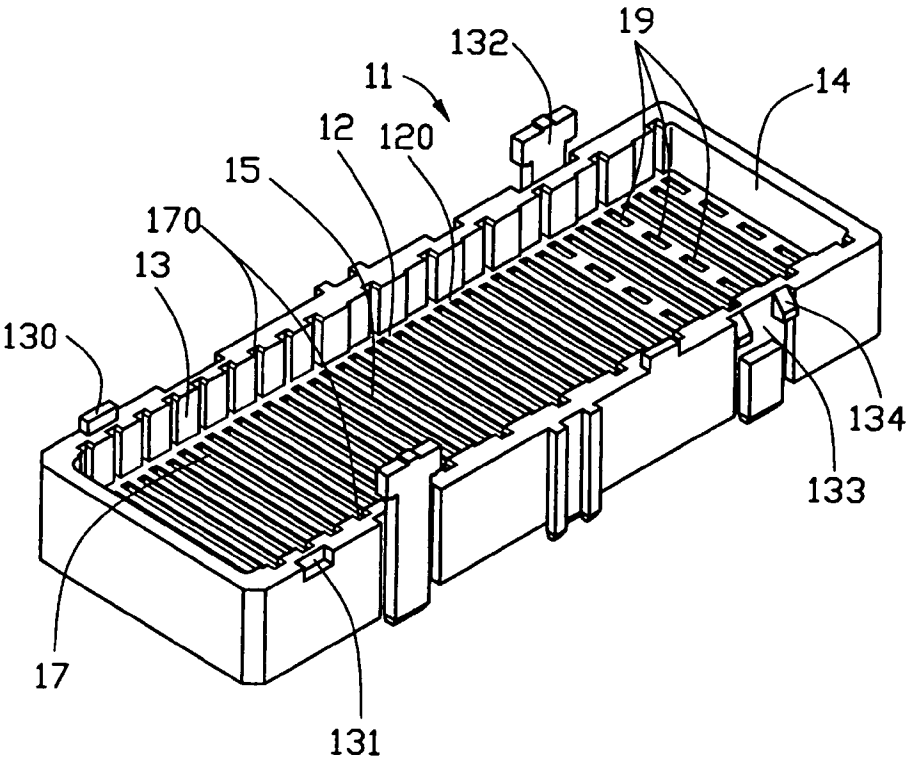
FIG. 3 is a perspective view of a cover half shown in FIG. 1 taken from another aspect.

Referring to FIGS. 1–3, the mating extender 1 comprises a box-shaped cover 10 including a pair of cover halves 11 engaging with each other. Each cover half 11 has a bottom wall 12, a pair of opposite side walls 13 extending from opposite sides of the bottom wall 12 and a pair of opposite end walls 14 extending from opposite ends of the bottom wall 12 and interconnecting with the side walls 13. A semi-receiving space 15 is defined between an inner face 120 of the bottom wall 12, the side walls 13 and the end walls 14. The semi-receiving spaces 15 of the two halves 11 of the cover 10 form a whole receiving space when the two halves 11 engage with each other. Accordingly, a mating port 16 is defined between a mating face 121 of the bottom wall 12 opposite to the inner face 120, the side walls 13 and the end walls 14. The bottom wall 12 defines a plurality of parallel slots 17 extending between the side walls 13 in the inner face 120 thereof and a plurality of columns of openings 18 in the mating face 121. The bottom wall 12 further defines a plurality of columns of holes 19 passing therethrough and each column of holes 19 is arranged along a direction parallel to the slots 17. Each column of openings 18 is communicated with a corresponding slot 17. A pair of opposite guiding channels 170 is provided on the side wall 13 at opposite ends of one of every two adjacent slots 17 and each columns of holes 19. One side wall 13 is formed with a projection 130 at an upper edge thereof and another side wall 13 defines a cutout 131 at an upper edge thereof. Each side wall 13 comprises a T-shaped resilient latch 132 upwardly projecting beyond the upper edge thereof, a T-shaped receiving recess 133 defined in an exterior face thereof and a lead-in 134 in the receiving recess 133. As best shown in FIG. 2, in assembly of the mating extender 1, the projection 130 of one cover half 11 is received in the cutout 131 of the other cover half 11. Accordingly, the resilient latch 132 of one cover half 11 is firstly deflected outwardly due to pressing of the lead-in 134 and then snap into the receiving recess 133 of the other cover half 11. The side wall 13 is formed with a pair of guide ribs 135 on the exterior face thereof.

Referring to FIG. 1, the mating extender 1 comprises a plurality of differential signal wafers 20, single-ended signal wafers 30 and shielding wafers 40 received in the whole receiving space of the cover 10 with opposite ends of the wafers respectively retained in corresponding slots 17.

Figure 5A:
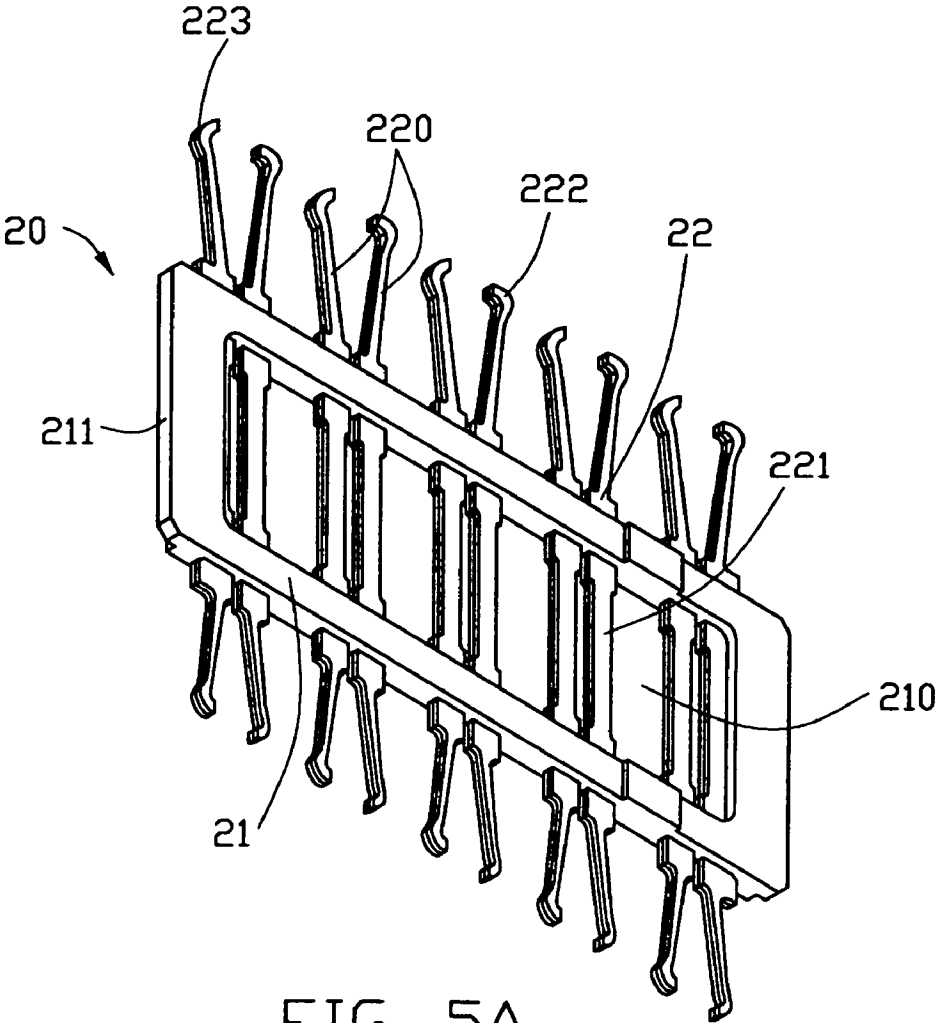
FIG. 5A is a perspective view of a differential signal wafer shown in FIG. 1.

Referring to FIG. 5A, each differential signal wafer 20 comprises an insulative frame 21 comprising a chamber 210 defined in a central portion thereof for saving material and improving electrical performance, and a pair of guiding flanges 211 at opposite side edges thereof. The guiding flanges 211 of the insulative frame 21 slide into the guiding channels 170 provided on the side wall 13 for guiding the differential signal wafer 20 correctly insertion. The differential signal wafer 20 further comprises a plurality of pairs of differential signal contacts 22 each pair formed by two pairs of differential signal semi-contacts 23 (FIG. 5B).

Figure 5B:
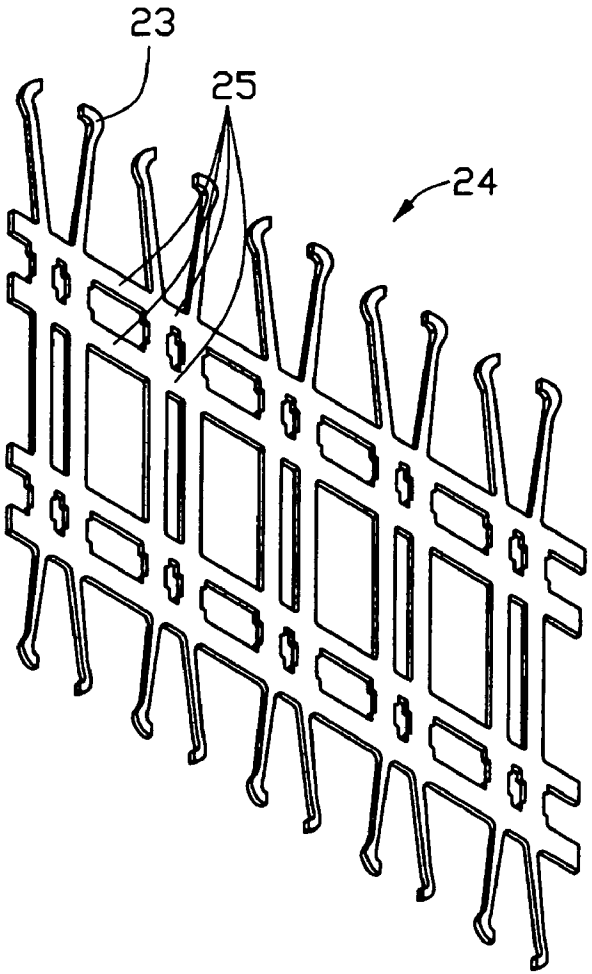
FIG. 5B is a perspective view of a metallic lead frame with a plurality of differential signal semi-contacts shown in FIG. 5A.

Referring to FIG. 5B, a metallic lead frame 24 is provided with a plurality of differential signal semi-contacts 23. Two pieces of lead frames 24 are stacked with corresponding differential signal semi-contacts 23 entirely and electrically overlapped with each other to form the differential signal contacts 22. The stacked lead frames 24 are insert molded into the insulative frame 21. When assembled, tie bars 25 of the lead frame 24, which are connected between the adjacent differential signal semi-contacts 23, are cut away to provide electrically isolated differential signal contacts 22.

Each differential signal contact 22 comprises two pairs of resilient contact tails 220 respectively at opposite ends thereof, and an elongated intermediate portion 221 between the two pairs of the contact tails 220 and partially exposed into the chamber 210. Each pair of contact tails 220 is formed with a pair of contacting portions 222 at a free end thereof and completely overlapped with each other. Each pair of contact tails 220 is exposed into the mating port 16 of the halves 11 of the cover 10 through one and the same hole 19, shown in FIG. 2.

Figure 6A:
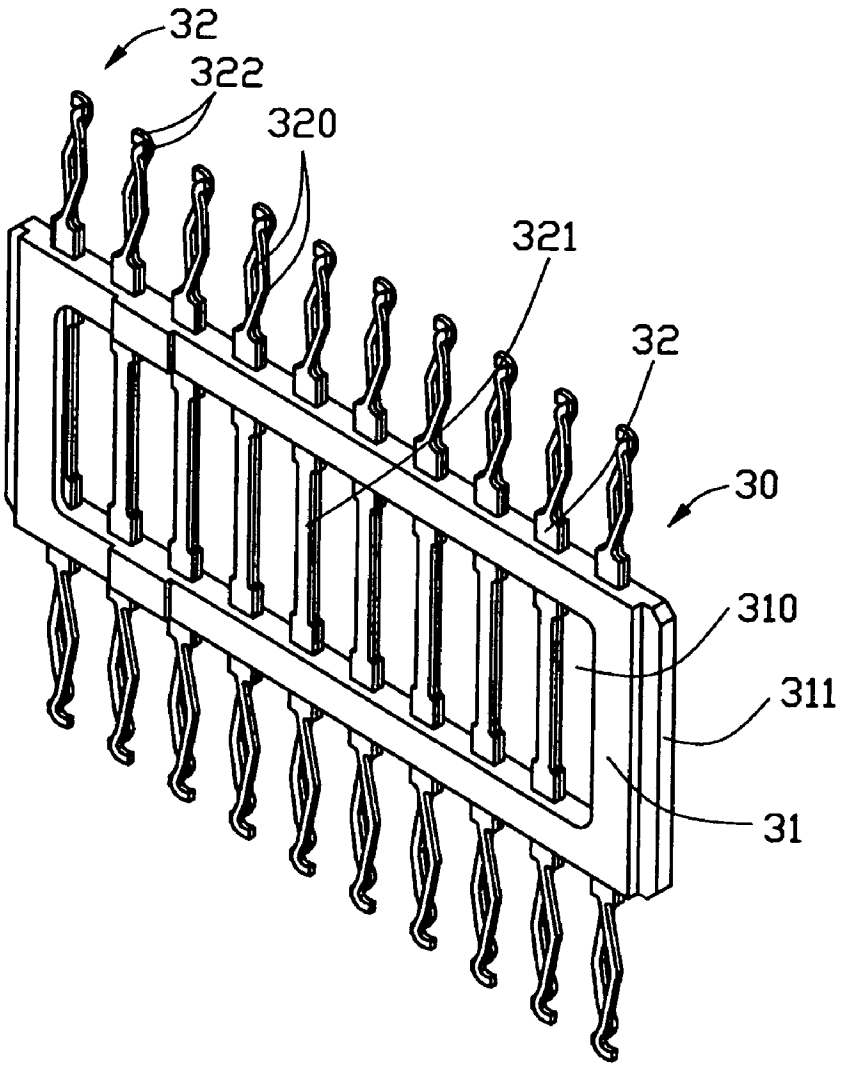
FIG. 6A is a perspective view of a single-ended signal wafer shown in FIG. 1.

Referring to FIG. 6A, likewise, each single-end signal wafer 30 comprises an insulative frame 31 defining a chamber 310 in a central portion thereof and a pair of guiding flanges 311 at opposite side edges thereof. The guiding flanges 311 of the wafer 30 slide into the guiding channels 170 provided on the side wall 13 for guiding the single-ended signal wafer 30 correctly inserting into the slot 17.

Figure 6B:
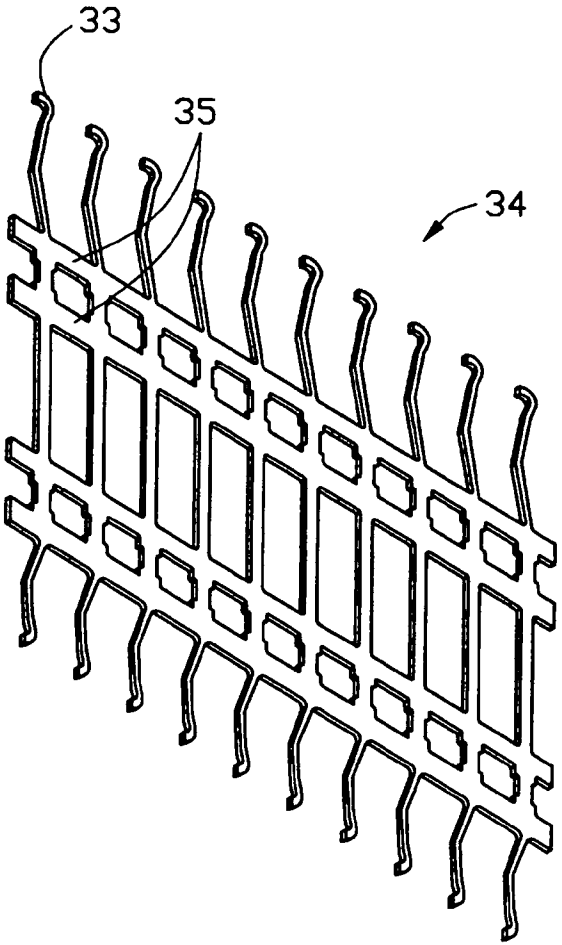
FIG. 6B is a perspective view of a metallic lead frame with a plurality of single-ended signal semi-contacts shown in FIG. 6A.

Referring to FIG. 6B and in conjunction with FIG. 6A, the single-ended signal wafer 30 further comprises a plurality of single-ended signal contacts 32 each formed by a pair of single-ended signal semi-contacts 33. A metallic lead frame 34 is provided with a plurality of single-ended signal semi-contacts 33. Two pieces of metal lead frames 34 are reversely stacked with corresponding single-ended signal semi-contacts 33 electrically and partially overlapped with each other to form the single-ended signal contacts 32. The stacked lead frames 34 are insert molded into the insulative frame 31. When assembled, tie bars 35 of the metal lead frame 34, which are connected between the adjacent single-ended signal semi-contacts 33, are cut away to provide electrically isolated single-ended signal contacts 32.

Each single-ended signal contact 32 comprises two pairs of resilient contact tails 320 at opposite ends thereof respectively, and an intermediate portion 321 between the two pairs of contact tails 320. Each pair of contact tails 320 is exposed into the mating port 16 through one and the same opening 18 of the cover halves 11, shown in FIG. 2. Each pair of contact tails 320 has a pair of contact portions 322 partially overlapped with each other.

Figure 7A:
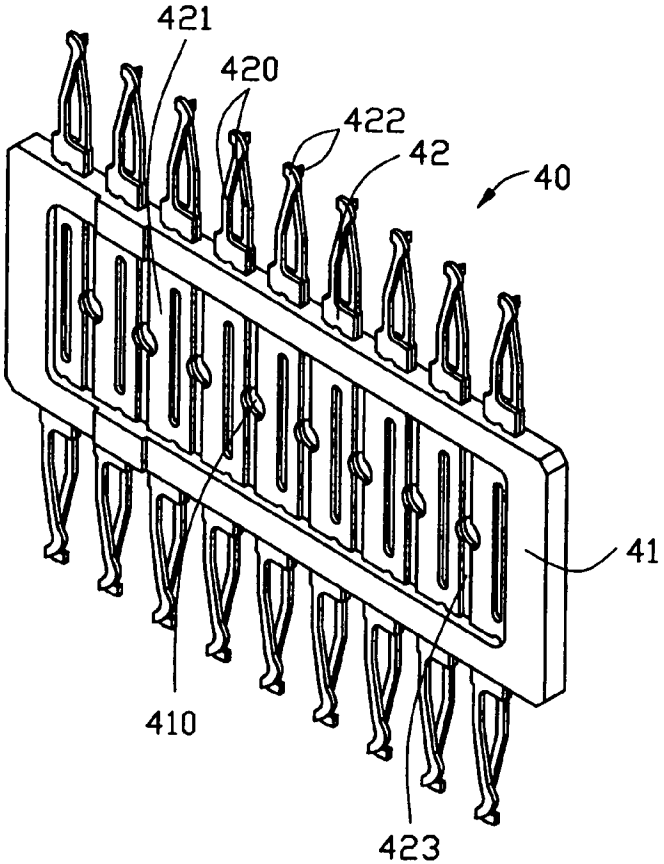
FIG. 7A is a perspective view of a shielding wafer shown in FIG. 1.
Figure 7B:
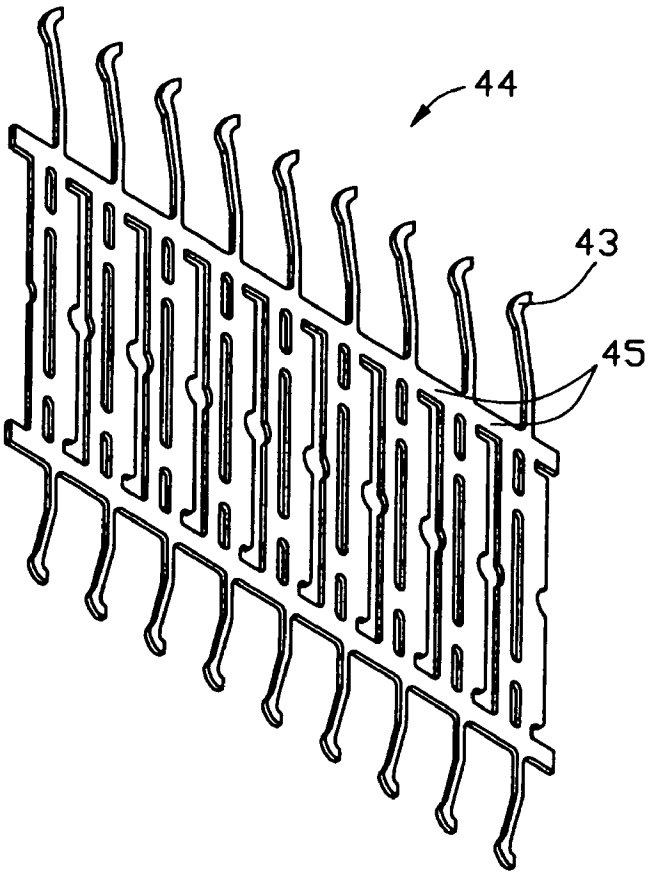
FIG. 7B is a perspective view of a metallic lead frame with a plurality of grounding semi-contacts shown in FIG. 7A.

Referring to FIGS. 7A–7B, each shielding wafer 40 is disposed between every two adjacent signal wafers 20, 30 for shielding purpose in the present embodiment. As everybody known, there may also be some other arrangement depending upon electrical performance requirements. Likewise, the shielding wafer 40 comprises an insulative frame 41 defining a chamber 410 in a central portion thereof and a plurality of grounding contacts 42 each formed by a pair of grounding semi-contacts 43. A metallic lead frame 44 is provided with a plurality of grounding semi-contacts 43. Two pieces of lead frames 44 are reversely stacked with corresponding grounding semi-contacts 43 electrically and partially overlapped each other to form the grounding contacts 42. The lead frames 44 are insert molded into the insulative frame 41. When assembled, tie bars 45 of the metal lead frame 44, which are connected between the adjacent grounding semi-contacts 43, are cut away to provide electrically isolated grounding contacts 42.

Each grounding contact 42 comprises two pairs of resilient contact tails 420 respectively at opposite ends thereof, and an intermediate portion 421 between the two pairs of contact tails 420. Each pair of contact tails 420 is exposed into the mating port 16 through one and the same opening 18 of the cover halves 11, shown in FIG. 2. Each pair of contact tails 420 has a pair of contact portions 422 partially overlapped with each other. The intermediate portion 421 of the grounding contact 42 is formed by two interlapped interims of the grounding semi-contacts 43 and has a pair of stagger side edges 423, whereby the grounding contacts 42 not only establish a continuous shielding plane but also are electrically isolated from each other.

Referring to FIGS. 4 and 8A–8C, the header 8 comprises an insulative housing 80 including a mating space 81 defined in a center area thereof, a platform 82 projecting into the mating space 81, and a plurality of columns of contacts 83 parallelly retained in the insulative housing 80. Each contact 83 comprises a flat contact plate 84 having a pair of opposite interface 840 and a solder tail 85 having a solder ball attached thereon for surface mounting on the backplane. The insulative housing 80 defines a pair of guiding slits 86 in an inner face of the mating space 81 for receiving corresponding guiding ribs 135 of the mating extender 1.

Figure 8A:
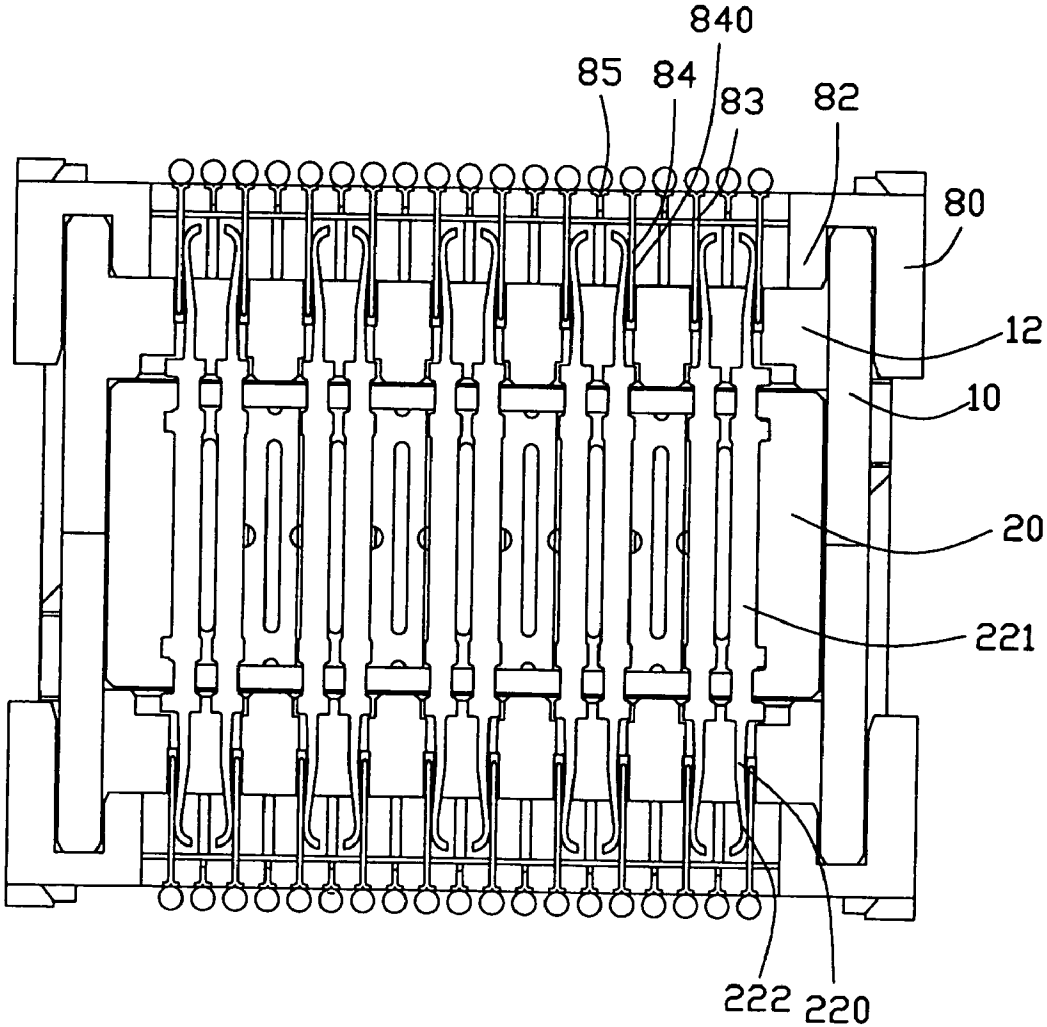
FIG. 8A is a planar view schematically showing a differential signal wafer of FIG. 5A mating with a pair of headers of FIG. 4.
Figure 8B:
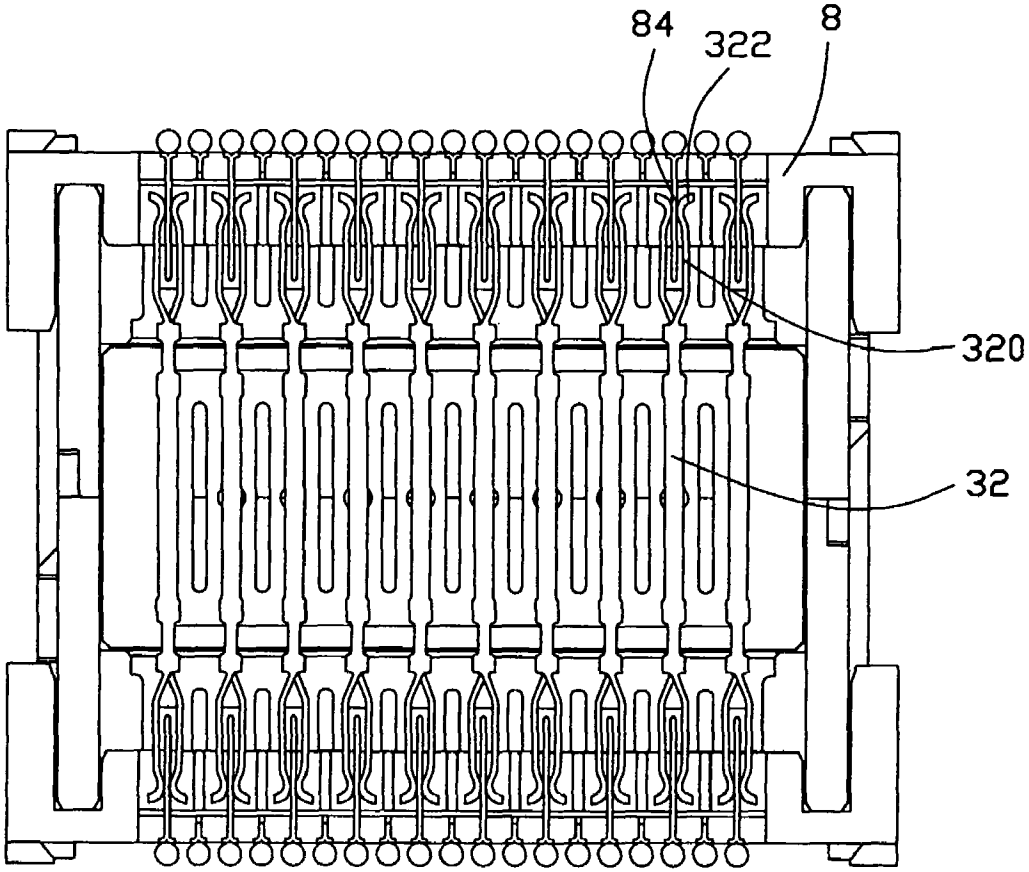
FIG. 8B is a planar view schematically showing a single-ended signal wafer of FIG. 6A mating with the pair of headers shown in FIG. 4.
Figure 8C:
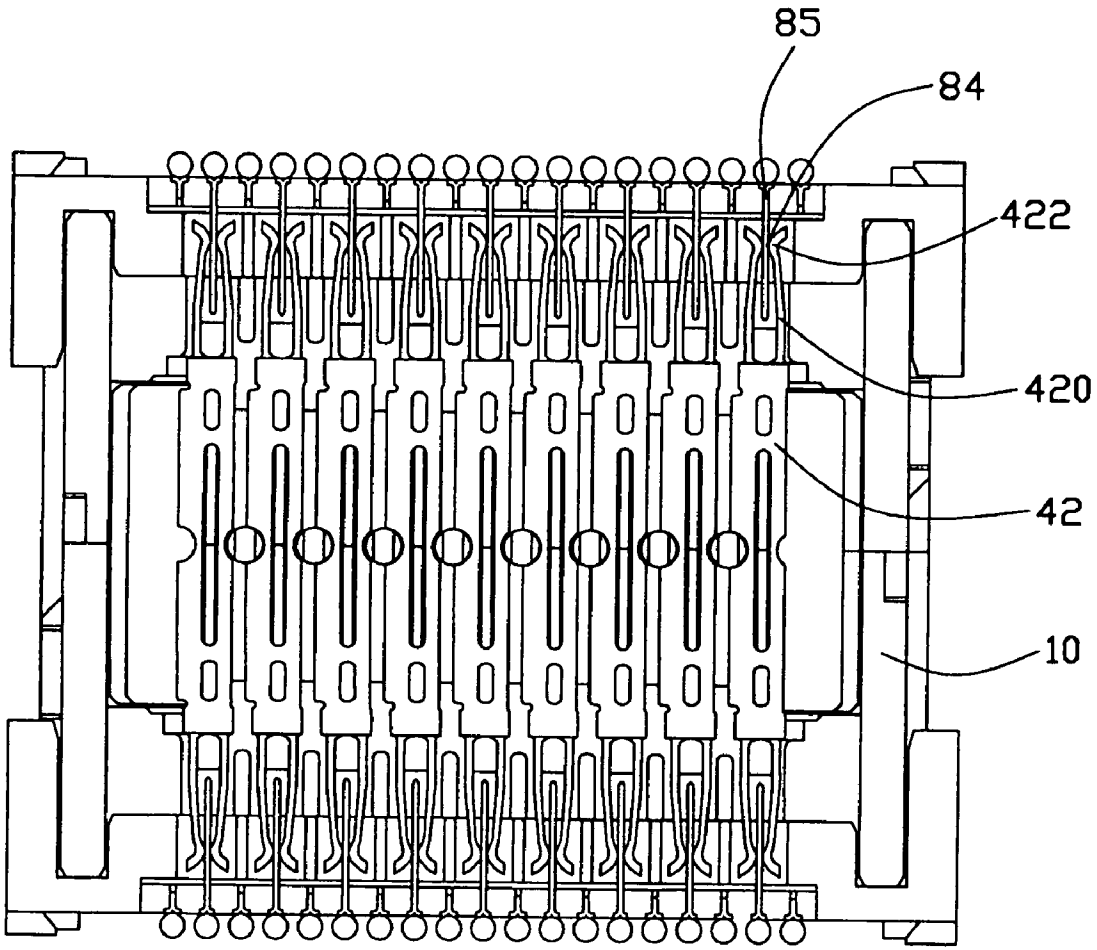
FIG. 8C is a planar view schematically showing a shielding wafer of FIG. 7A mating with the pair of headers shown in FIG. 4.

When the mating extender 1 is mated with the pair of headers 8, opposite mating parts of the mating extender 1 are received in the mating spaces 81 of the headers 8 with the platforms 82 of the headers 8 received in the mating ports 16 of the mating extender 1. Referring to FIG. 8A, the contact portion 222 of the differential signal contact 22 resiliently abuts against a corresponding interface 840 of the contact plate 84 of the header 8. Because the differential signal contact 22 is formed by two signal semi-contacts 23, each pair of completely overlapped contact portions 222 of the differential signal contacts 22 has a redundant interface 223 for electrically contacting with the interface 840 of the contact plate 84 of the header 8. It should be noted that the interface 223 of the differential signal contact 22 extends in a first plane perpendicular to a second plane which the differential signal wafer 20 lies in. Referring to FIG. 8B, the pair of contact tails 320 of the single-ended signal contact 32 is deflected outwardly due to the insertion of corresponding contact plate 84 of the header 8. The contact portions 322 of the pair of contact tails 320 resiliently sandwich the corresponding contact plate 84 of the header 8 therebetween. Referring to FIG. 8C, likewise, the pair of contact tails 420 of the grounding contact 42 is deflected outwardly due to the insertion of corresponding contact plate 84 of the header 8. The contact portions 422 of the pair of contact tails 420 resiliently sandwich the corresponding contact plate 84 of the header 8 therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mating extender comprising:

an insulative housing having first and second mating ports;

a plurality of parallel wafers retained in the insulative housing, each wafer comprising an insulative frame and a plurality of contacts each formed by a pair of stacked semi-contacts, each contact having an intermediate portion retained in the insulative frame, a pair of first contact tails and a pair of second contact tails at opposite ends of the intermediate portion, the first and second contact tails exposed into the first and the second mating ports, respectively, the first contact tails of the contact comprising a pair of partially overlapped contact portions.

2. The mating extender according to claim 1, wherein the first contact tails of the contact comprises a pair of partially overlapped contact portions.

3. The mating extender according to claim 1, wherein the insulative frame of the wafer defines a chamber in a center portion thereof.

4. The mating extender according to claim 1, wherein the first contact tail of the contact has an interface lying in a first plane, and wherein the wafer lies in a second plane perpendicular to the first plane.

5. The mating extender according to claim 4, wherein the wafers comprise a plurality of signal and shielding wafers alternatively arranged with each other.

6. The mating extender according to claim 5, wherein the contacts of the shielding wafers are electrically isolated one another.

7. The mating extender according to claim 6, wherein the intermediate portion of the contact of the shielding wafer is formed by two interlapped interims of the semi-contacts.

8. The mating extender according to claim 1, wherein the insulative housing comprises two housing halves.

9. The mating extender according to claim 8, wherein one housing half comprises a resilient latch at a side wall thereof and another housing half defines a receiving recess in an exterior face thereof receiving the resilient latch.

10. The mating extender according to claim 8, wherein each housing half defines a plurality of parallel slots receiving the wafers.

11. The mating extender according to claim 10, wherein the housing half defines a pair of guiding channels at opposite ends of the slots, and wherein the insulative frame of the wafer is formed with a pair of guiding flanges at opposite ends thereof for sliding into corresponding guiding channels.

12. The mating extender according to claim 11, wherein the housing half defines a plurality of columns of passageways receiving corresponding contact tails of the contacts, each column of passageways communicating with a corresponding slot.

13. A mating extender for use with two opposite connectors, comprising:

an insulative housing including first and second halves commonly defining an enclosed cavity therebetween; and a plurality of wafers retained in said cavity in a parallel relation with one another, each wafer defining an insulative frame with a plurality of contact thereon; wherein each of said contacts including an intermediate portion disposed in the cavity and opposite first and second mating portions extending in opposite direction away from each other and out of the corresponding halves to be exposed to an exterior for mating with the corresponding connectors, respectively.

14. The mating extender according to claim 13, wherein said first and second halves are similar to each other while assembled to each other in a mutually reversed manner.

15. An electrical assembly comprising:

first and second connector oppositely arrange with each other in a spaced distance along a direction;

an extender sandwiched between said first and second connectors in said first direction, the extender including:

first and second halves similar to and assemble to each other and commonly defining a cavity therein; and a plurality of contacts disposed the cavity, each of the contacts including an intermediate section disposed in the cavity, and opposite first and second mating sections extending from two opposite ends of the intermediate section away from each other oppositely in said direction, and out of the corresponding first and second halves to mate with the corresponding first and second connectors, respectively.

16. The assembly according to claim 15, wherein said first and second mating sections are similar to each other and symmetrically arranged with each other relative to the intermediate section.

* * * * *